US009483024B2

(12) United States Patent
Goyet et al.

(10) Patent No.: US 9,483,024 B2
(45) Date of Patent: Nov. 1, 2016

(54) PLASTIC WATCH CASE COVERED WITH TWO METALLIC HALF SHELLS

(71) Applicant: The Swatch Group Management Services AG, Biel (CH)

(72) Inventors: Damien Goyet, Winkel (FR); Silvano Bonadei, Delemont (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 14/540,090

(22) Filed: Nov. 13, 2014

(65) Prior Publication Data

US 2015/0177692 A1 Jun. 25, 2015

(30) Foreign Application Priority Data

Dec. 19, 2013 (EP) ..... 13198327

(51) Int. Cl.
*G04B 47/04* (2006.01)
*G04B 37/00* (2006.01)
(Continued)

(52) U.S. Cl.
CPC ..... *G04B 37/226* (2013.01); *G04B 37/00* (2013.01); *G04B 37/005* (2013.01); *G04B 37/0008* (2013.01); *G04B 37/22* (2013.01);
(Continued)

(58) Field of Classification Search
CPC G04B 37/0016; G04B 37/005; G04B 37/22; G04B 45/0076; G04B 47/04; G04B 47/046
USPC ..... 368/280, 281, 286, 309, 283, 285
See application file for complete search history.

(56) References Cited

U.S. PATENT DOCUMENTS 1,618,452 A * 2/1927 Lehr ..... G04B 37/05 368/281
3,740,944 A * 6/1973 Chopard ..... G04B 43/005 165/47

(Continued)

FOREIGN PATENT DOCUMENTS

| | | |
|---|---|---|
| CH | 351 545 | 1/1961 |
| DE | 41 12 679 A1 | 10/1992 |
| EP | 0 351 706 A1 | 1/1990 |

OTHER PUBLICATIONS

Emir, English Translation for CH 351545, originally published on Jan. 15, 1961, whole document.*

(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P

(57) ABSTRACT

A wristwatch includes a bracelet or strap, a plastic case, a watch crystal, a back cover and pairs of horns to which the ends of the bracelet or strap are attached. It also includes a top half shell made of metal which covers the top of the case and a portion of the case middle and which has an opening revealing the crystal. It further includes a crown or a control push-button protruding from the case middle. The wristwatch further includes a bottom half shell covering the back cover and a portion of the case middle. The top half shell and the bottom half shell respectively have two, substantially symmetrical, peripheral rims which extend facing each other, the crown or the control push-button being located in an elongated space extending between the rims of the two half shells. The elongated space also reveals a portion of the case middle.

10 Claims, 3 Drawing Sheets

(51) Int. Cl.
*G04B 37/22* (2006.01)
*G04B 45/00* (2006.01)

(52) U.S. Cl.
CPC ..... *G04B45/0076* (2013.01); *G04B 47/04* (2013.01); *G04B 47/046* (2013.01)

(56) References Cited

U.S. PATENT DOCUMENTS 4,999,823 A 3/1991 Grosjean
5,065,375 A * 11/1991 Gogniat ..... G04B 37/0008 368/281
5,901,117 A * 5/1999 Delabre ..... G04B 37/0058 368/276
5,943,302 A * 8/1999 Fanshaw ..... G04B 37/0008 368/276
2003/0112713 A1* 6/2003 Kaelin ..... G04B 37/0008 368/281
2006/0126444 A1* 6/2006 Ellner ..... G04B 37/127 368/246
2008/0225649 A1* 9/2008 Andren ..... G04B 37/1486 368/282

OTHER PUBLICATIONS

European Search Report issued Jul. 31, 2014 in European Application 13198327, filed on Dec. 19, 2013 ( with English translation).

* cited by examiner

PLASTIC WATCH CASE COVERED WITH TWO METALLIC HALF SHELLS

This application claims priority from European Patent application No. 13198327.2 filed on Dec. 19, 2013, the entire disclosure of which is hereby incorporated herein by reference.

FIELD OF THE INVENTION

The present invention relates to a wristwatch including a bracelet or strap, a plastic case including a case middle-bezel, a watch crystal, a back cover and two pairs of horns to which the two ends of the bracelet or strap are respectively attached, and including a top half shell made of metal covering the top of the case and a portion of the case middle, and having an opening revealing the crystal, and further including a crown or a control push-button protruding from the case middle.

PRIOR ART

There are known wristwatches which conform to the above definition. EP Patent No 0351706, in particular, discloses a watch whose case includes a plastic case middle-bezel covered by a metal cap. The cap is capable of covering the bezel part of the case middle-bezel and extends at least partially along the visible side of the case middle part of the case middle-bezel. According to the prior art, when the watch is worn on the wrist, the presence of the cap gives the impression that the watch is made of metal. However, this prior art watch has certain drawbacks. Indeed, if the watch is turned over, to change the battery for example, the impression of high quality is spoiled by the presence of the rim of the cap which surrounds the back cover. Attempts have been made without great success to conceal the join between the rim of the cap and the plastic of the case. It is an object of the present invention to overcome the problem of the prior art that has just been described.

BRIEF SUMMARY OF THE INVENTION

To this end, the present invention provides a wristwatch.

It will be understood that, according to the invention, the two joins respectively formed between the rims of the two half shells and the plastic of the case are not concealed. Moreover, since there is an empty space between the rims of the two half shells, there is considerable freedom as to the choice of the height of the rims of the shells. Moreover, as the rims do not need to be parallel, the same freedom is available for devising the profiles of the two rims. Further, the fact of passing the crown or the push-button between the two half shells also contributes to easing the constraints as regards the shape of each of the half shells.

BRIEF DESCRIPTION OF THE DRAWINGS

Other features and advantages of the invention will appear upon reading the following description, given solely by way of non-limiting example, with reference to.

DETAILED DESCRIPTION OF ONE EMBODIMENT

Figure 1:
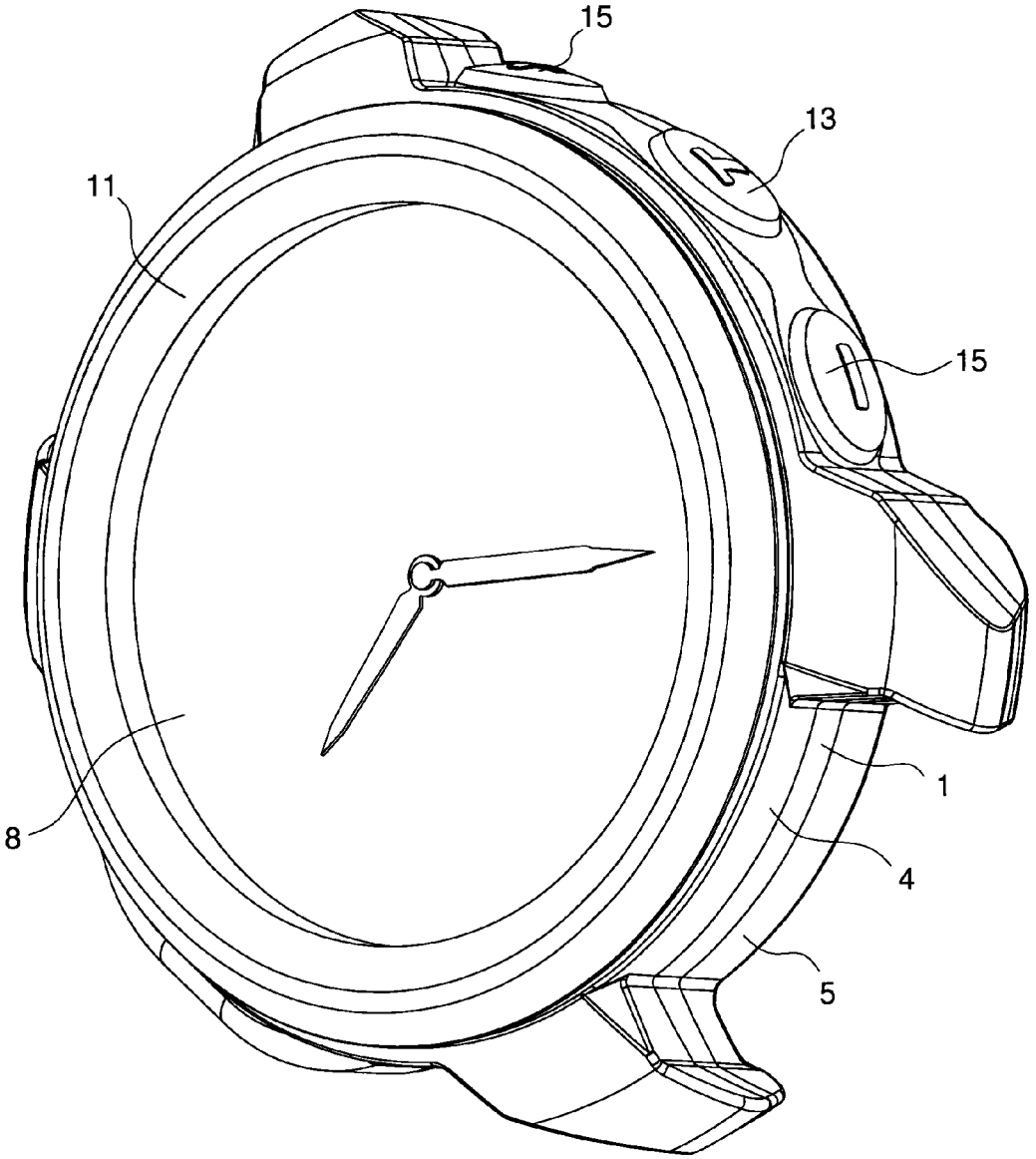
FIG. 1 is a perspective view of a wristwatch according to a particular embodiment of the invention; the bracelet is not shown.
Figure 2:
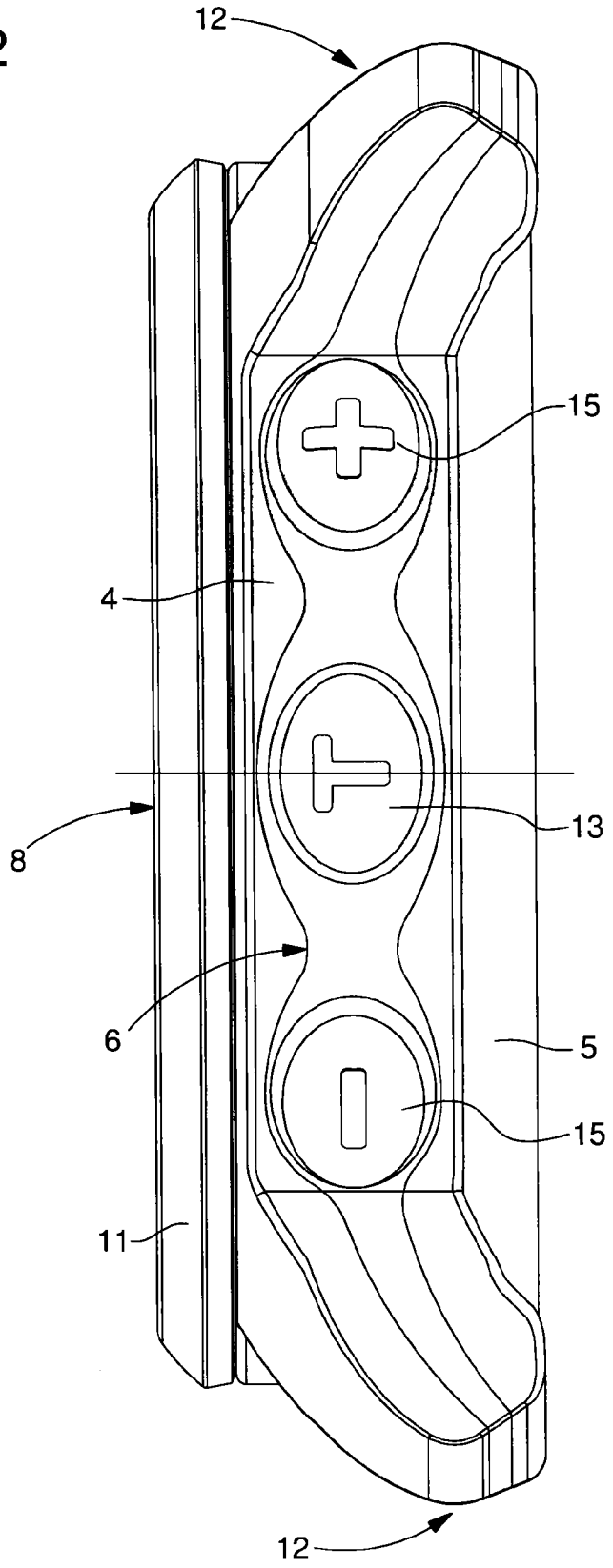
FIG. 2 is a side view of the wristwatch of FIG. 1.

FIGS. 1 and 2 are respectively perspective and side views of a wristwatch according to a particular embodiment of the invention. The watch case (general reference 1) is round and (general reference 1) carries two pairs of horns 12 for attaching a bracelet or strap (not shown; a horn of each pair is visible in FIG. 1). The watch shown is a chronograph watch provided with a time-setting crown and two push-buttons 15.

Figure 3:
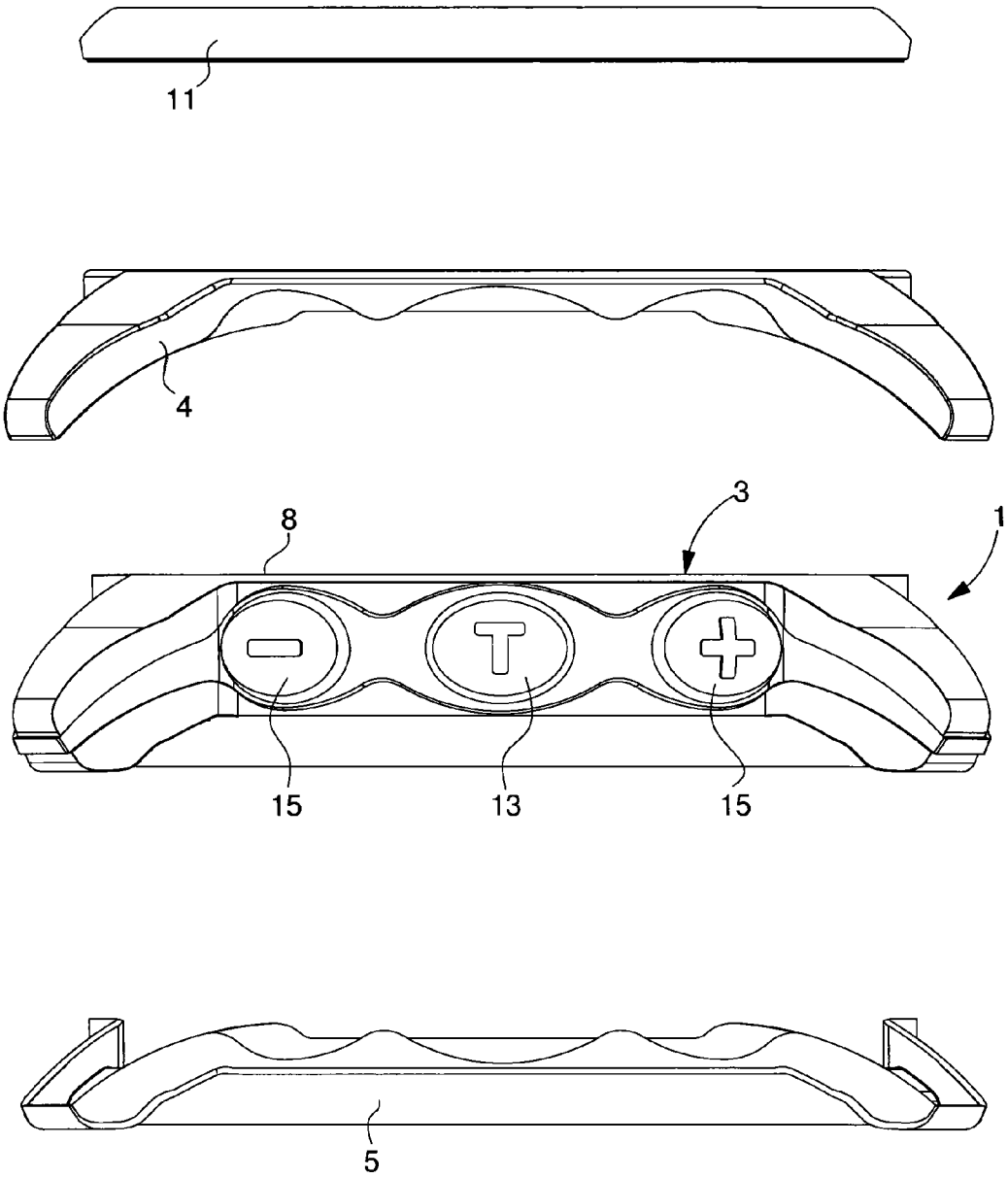
FIG. 3 is an exploded view showing the watch case, the two half shells and the annular cap of the watch of FIGS. 1 and 2.

According to the invention, the watch includes a top half shell 4 and a bottom half shell 5. The top half shell 4 covers the top of case 1, the top portion of the case middle and the top of horns 12. The top half shell has a circular opening arranged for the passage of the bezel and the crystal of watch 8 (seen in FIG. 3). The bottom half shell 5 covers the back cover of case 1 and the bottom portion of the case middle. According to the invention, an elongated space 6 is arranged between the top half shell and the bottom half shell. In the illustrated example, space 6 has the shape of a horizontal strip at mid-height on the case middle, a portion of the case middle being visible in this space. Further, crown 13 and the two push-buttons 15 are also placed in space 6.

The manufacture of the two half shells according to the invention typically includes several steps, for example a preliminary stamping operation followed, in the case of the half shells, by drawing. Top half shell 4 and bottom half shell 5 with their curved shape and lateral walls are obtained from these operations, as is opening 3 in top half shell 4. The thickness of the metallic sheet used to make the two half shells is advantageously around 0.3 mm. Once half shells 4 and 5 are formed, they are preferably bonded to the watch case.

In the embodiment illustrated, a bezel-shaped annular cap 11 covers bezel 8. Cap 11 conceals the join between bezel 8 and the metallic half shell 4. Cap 11 is preferably bonded on after the top half shell 4 has been attached.

What is claimed is:

1. A wristwatch, comprising:

a bracelet or strap;

a plastic case including a case middle-bezel, a watch crystal, a back cover, and two pairs of horns to which two ends of the bracelet or strap are respectively attached;

a top half shell made of metal covering the top of the case and a portion of the case middle, and having an opening revealing the crystal;

a crown or a control push-button protruding from the case middle; and a bottom half shell covering the back cover and a portion of the case middle, wherein the top half shell and the bottom half shell respectively have two, substantially symmetrical, peripheral rims and which extend facing each other, the crown or the control push-button being located in an elongated space extending between the rims of the two half shells, and the elongated space also revealing a portion of the case middle, and wherein the elongated space reveals a side portion of each horn of the two pairs of horns.

2. The wristwatch according to claim 1, wherein the half shells are shaped by drawing before being attached to the watch case.

3. The wristwatch according to claim 1, wherein the bottom half shell is made of metal.

4. The wristwatch according to claim 1, wherein the half shells are shaped by drawing a metallic sheet before being attached to the watch case.

5. The wristwatch according to claim 4, wherein a thickness of the metallic sheet used to make the half shells is 0.3 mm.

6. The wristwatch according to claim 1, further comprising:

a cap that seals a connecting surface between the case middle-bezel and the top half shell.

7. The wristwatch according to claim 1, wherein the case is round.

8. The wristwatch according to claim 1, wherein the two pairs of horns extend outward from an outer wall of the case, the top half shell covers a front of the two pairs of horns, and the bottom half shell covers a back of the two pairs of horns.

9. The wristwatch according to claim 1, wherein the top half shell is joined to the case at a connecting surface, the bottom half shell is joined to the case at a connecting surface, and wherein the connecting surface between the top half shell and the case is not concealed and the connecting surface between the bottom half shell and the case is not concealed.

10. A wristwatch, comprising:

a bracelet or strap;

a plastic case including a case middle-bezel, a watch crystal, a back cover, and two pairs of horns to which two ends of the bracelet or strap are respectively attached;

a top half shell made of metal covering the top of the case and a portion of the case middle, and having an opening revealing the crystal;

a crown or a control push-button protruding from the case middle; and a bottom half shell covering the back cover and a portion of the case middle, wherein the top half shell and the bottom half shell respectively have two, substantially symmetrical, peripheral rims and which extend facing each other, the crown or the control push-button being located in an elongated space extending between the rims of the two half shells, and the elongated space also revealing a portion of the case middle, and wherein the elongated space extends continuously between a first horn of the two pairs of horns and a second horn of the two pairs of horns, the first horn being located on an upper right portion of the case and the second horn being located on a lower right portion of the case.

* * * * *